US005586948A

United States Patent [19]

Mick

[11] Patent Number: 5,586,948

[45] Date of Patent: Dec. 24, 1996

[54] METAL WOOD GOLF CLUB HEAD

[76] Inventor: Phillip J. Mick, 7831 Alabama, #16, Canoga Park, Calif. 91304

[21] Appl. No.: 428,779

[22] Filed: Apr. 24, 1995

[51] Int. Cl.[6] ..... A63B 53/04

[52] U.S. Cl. ..... 473/332; 473/342; 473/346; 273/DIG. 8

[58] Field of Search ..... 273/167 H, 169; 473/332, 342, 346, DIG. 8

[56] References Cited

U.S. PATENT DOCUMENTS 4,498,672 2/1985 Bulla ..... 273/169

4,535,990 8/1985 Yamada ..... 273/167 H X 5,295,689 3/1994 Lundberg ..... 273/167 H

*Primary Examiner*—George J. Marlo

*Attorney, Agent, or Firm*—Kelly, Bauersfeld & Lowry

[57] ABSTRACT

A metal wood type golf club head provided with a conically shaped metal sleeve filled with hard polyurethane material and disposed within the club head shell to extend between the club face plate and back end portion of the club head.

9 Claims, 1 Drawing Sheet

FIG. 1
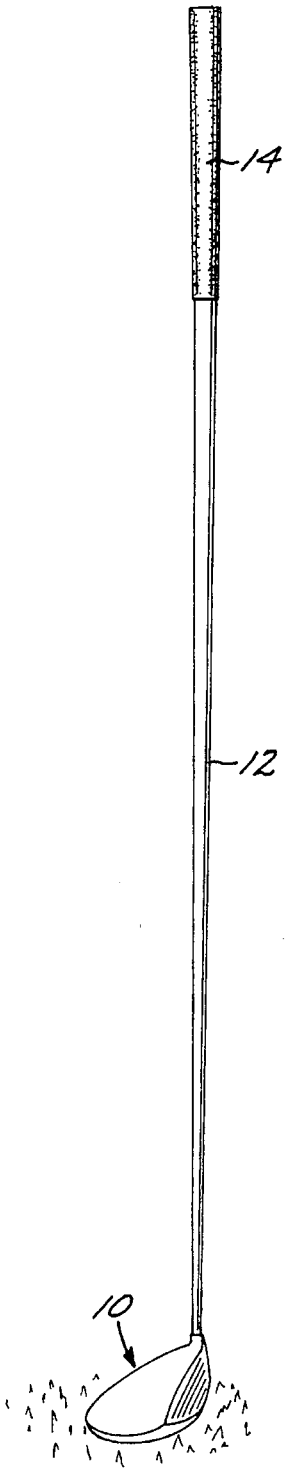
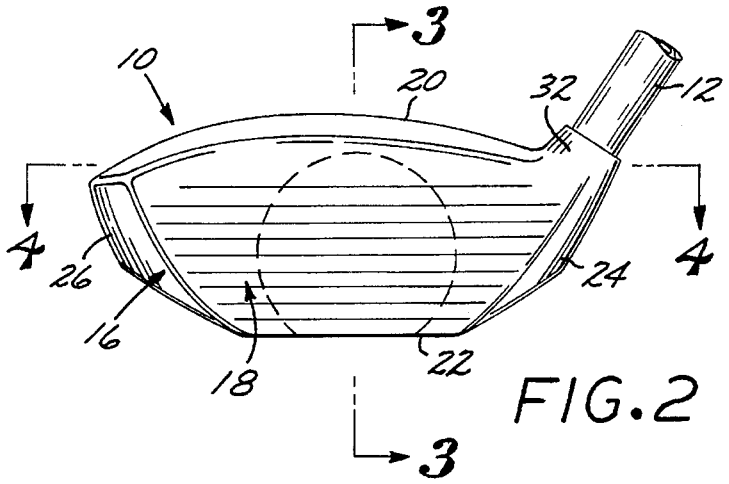
FIG. 2
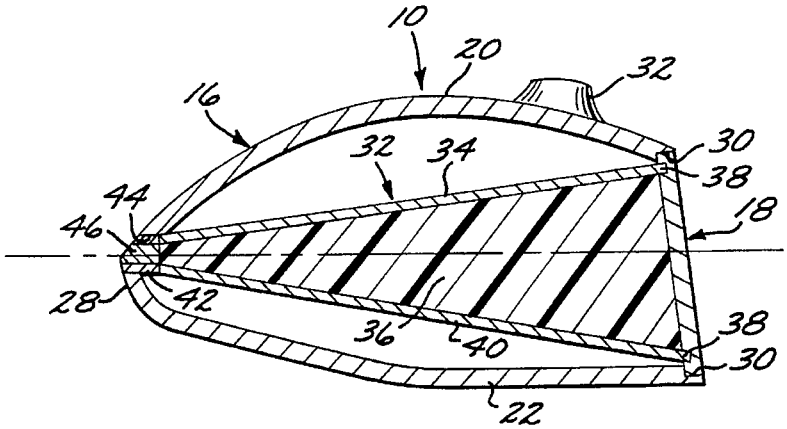
FIG. 3
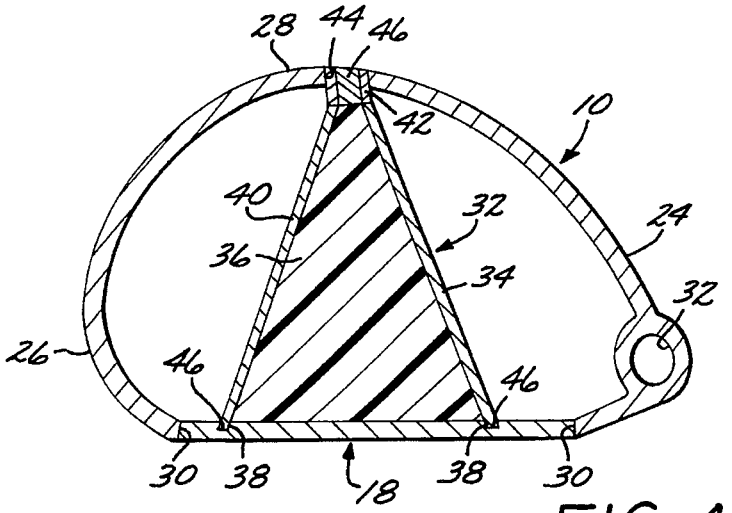
FIG. 4

METAL WOOD GOLF CLUB HEAD

BACKGROUND OF THE INVENTION

This invention relates to golf clubs, and more specifically, to a new and improved construction for the head of a golf club of the type known as a "metal wood."

The use of "metal wood" type golf clubs has steadily increased in recent years. Typically, such golf clubs are used as a replacement for the more traditional wooden head type golf club, and are usually made from metal castings to have head shapes generally similar to that of the corresponding wooden head type club. Normally, the metal castings used for metal wood club heads have hollow interiors, and are formed using a "lost wax" or similar destructible core type casting technique to provide a single piece hollow shell head.

While metal wood golf clubs have met with substantial commercial success, several problems have resulted which make metal woods less than ideal. One problem is that the metal wood head tends to transmit undesirable impact caused vibration from the head to the shaft of the club. This is due, at least in part, to the fact that the metal shell forming the hollow head of conventional metal wood clubs is not capable of absorbing significant amounts of vibration caused in the head when a golf ball is hit. That is, when the hollow shell forming the metal wood head impacts a golf ball, harmonic waves are produced in the head as the head plastically deforms and then rebounds as a result of kinetic energy transfer. Since the metal wood head is hollow, the harmonic waves created are not significantly absorbed or dissipated in the club head itself, and may be transferred through the club shaft to the user. This has the undesirable effect of tending to produce discomfort and increased incidents of tendinitis.

Another problem that has been encountered with metal wood clubs of the prior art type is that the hollow heads are very sensitive to the position of ball strike on the club face. Unless the user strikes the ball directly in the center or "sweet spot" of the hollow club head, the impact forces will be unevenly distributed throughout the head, thereby changing the dynamic properties of the head and reducing its efficiency and effective distance of resultant ball travel. A further problem is that many users dislike the "ping" or "tink" type sounds produced when the hollow metal wood head strikes a ball and it has been found that hollow heads tend to be more easily damaged, particularly in the area of the club face, than conventional wooden heads.

As will become more apparent hereinafter, the present invention provides a new and improved construction for a metal wood type golf club head which solves the foregoing problems associated with the prior art heads, and also provides a further advantage thereover of increased efficiency and effective range.

SUMMARY OF THE INVENTION

In accordance with the present invention, the head of the metal wood is provided with a specially designed and constructed compression chamber within the cast metal shell behind the club head face plate, and which acts to reflect the shock energy of impact imparted to the head back to the ball, as well as to absorb harmonic vibrations in such a manner as to very substantially reduce the transfer of vibrational energy to the user while increasing the amount of energy transferred to the golf ball, thereby increasing the effective range of the club.

More specifically, the metal wood head of the present invention is constructed with a cone-shaped metal chamber filled with a relatively hard, polyurethane material which acts as a shock wave absorber and reflector to transmit energy back to the ball and simultaneously reduce the harmonic wave energy developed within the head. The provision of the polyurethane filled compression chamber provides a metal wood club head which has a more solid feel and sound as compared with prior art hollow metal wood heads, and which is less sensitive to ball strike position while also providing greater club range.

These and other advantages of the present invention will become more apparent from the following detailed description taken in conjunction with the accompanying drawings which disclose, by way of example, the principles of the invention.

BRIEF DESCRIPTION OF THE DRAWINGS

FIG. 1 is a perspective view of a golf club of the metal wood type employing a head constructed in accordance with the present invention;

FIG. 2 is an enlarged fragmentary front elevational view of the golf club head of FIG. 1;

FIG. 3 is a cross-sectional view of the club head of FIG. 1 taken substantially in the direction of the arrow 3—3 in FIG. 2; and FIG. 4 is a cross-sectional view of the head of FIG. 1 taken substantially in the direction of the arrow 4—4 of FIG. 2.

DETAILED DESCRIPTION OF THE PREFERRED EMBODIMENT

As shown in the exemplary drawings, the present invention is embodied in a new and improved golf club head 10 of the metal wood type. In this instance, as shown in FIGS. 1 and 2, the club head 10 is attached to the lower end portion of a conventional golf club shaft 12 which includes a conventional hand grip 14 disposed about its upper end. Herein, the club head 10 is formed from high strength aluminum alloy, and includes a body portion 16 and a face plate 18 forming the impact striking surface of the club head. Like many conventional metal wood club heads, the body portion 16 of the club head 10 is shaped to define an upper, convex top surface 20 vertically spaced from a flat bottom surface 22 defining a generally horizontal plane, the top and bottom surfaces being merged together by laterally spaced heel and toe side portions 24 and 26, respectfully, and a rear or back edge portion 28. The body portion 16 herein is formed as a hollow shell casting having an open front or forward end area 30 longitudinally spaced from the back end portion 28, and is provided with an upstanding hollow cylindrical boss 32 extending from the top 20 at the heel 24 and which is formed to receive the lower end portion of the club shaft 12, the latter being secured therein in any conventional manner.

Preferably, the body shell 16 of the head 10 is formed using a "lost wax" or destructible core sand casting technique to produce an integral one piece casting, and is dimensioned to permit the face plate 18 to be secured over the forward opening 30 so that the face plate is upwardly and rearwardly inclined with respect to the vertical between the bottom 22 and the top 20, the extent of the incline being determined by the amount of loft the club head is intended to impart to the ball. Additionally, although not shown in the drawings, a separate conventional aluminum sole plate can be secured to the bottom 22 of the club head 10 to protect the head from being damaged by rocks, stones, etc. during use.

In accordance with the present invention, the club head 10 is provided with a specially designed and constructed compression insert, generally designated 32, which acts to reflect impact caused shock energy from the club head back to the golf ball, and also to absorb and dissipate residual harmonic wave energy in the head itself without appreciable transfer through the club shaft 12 to the user. Moreover, the head 10 of the present invention is relatively simple in design and economical to manufacture, and produces a metal wood club head having a more solid feel and sound than comparable prior art hollow shell metal wood heads.

Toward the foregoing ends, the compression chamber insert 32 includes a truncated cone-shaped metal sleeve 34 having a right-circular conical configuration disposed within the club head shell 16 to extend generally horizontally from the club face plate 18 rearwardly to the back end 28 of the body shell. Disposed within and filling the sleeve 34 is a shock absorbing and energy transfer material 36, preferably a hard, thermosetting polyurethane material having a Shore D hardness of at least 80. Use of such a high Shore D hardness polyurethane material is particularly desirable since the material will readily adhere to the face plate 18 and sides of the sleeve 34, and has a substantially instantaneous compression recovery time with very little loss of energy. Further, the hard polyurethane material 36 is relatively light in weight so as not to add appreciably to the total weight of the club head 10.

In this instance, the sleeve 34, which preferably is formed from a rolled or extruded high strength aluminum alloy, has a forward or base end 38 dimensioned to have a diameter approximately equal to the height of the inner surface of the face plate 18 between the top 20 and bottom 22 of the club head shell 16, and a central portion 40 converging rearwardly to a relatively short, small diameter, cylindrical portion 42 which is adapted to project through a hole 44 formed in the back 28 of the cast shell.

Herein, the inner surface of the face plate 18 is formed with a circular groove 46 into which the base end 38 of the sleeve 34 is positioned and secured. Preferably, the base end 38 is secured to the face plate 18, such as by welding, prior to assembly of the face plate to the body shell 16 of the head 10 so that when the face plate is assembled with the head, the cylindrical portion 42 of the sleeve will project into the hole 44. Once assembled, the face plate 18 is preferably secured to the shell 16 by welding to produce a club head 10 of unitized, rigid construction.

Following assembly of the face plate 18 and sleeve 34 to the cast shell 16, liquid thermosetting polyurethane 36 is injected into the sleeve through the cylindrical portion 42 and hole 44, and the head is heated to set the material. Upon cooling, the polyurethane forms a solid insert which adheres to and fills the interior space inside the sleeve 34 from the face plate 18 rearwardly to the cylindrical apex portion 42. Preferably, a small interior void or space is left within the apex portion 42 so that a cylindrical metal plug 46, such as a threaded brass plug, can be secured therein to close the rear end of the sleeve 34 and encapsulate the polyurethane material 36 within the club head 10.

In simulated tests under fixed conditions, it was determined that for a club head speed of eighty miles per hour, a user of a metal wood club employing the club head 10 of the present invention could expect to increase the travel distance of a golf ball by about seven yards over a comparable prior art metal wood hollow shell head, and by over twenty yards at a club head speed of one hundred miles per hour. The increased range is believed to be due to the metal sleeve 34 and hard polyurethane material 36 which confines and reflects the shock waves developed by ball impact forwardly back to the ball through the face plate 18 with very little energy loss or absorption in the head itself.

Further, the provision of the compression insert 32 produces a more solid feel and sound on ball impact since the insert provides solid structural support behind the face plate 18, and reduces the change in dynamic response to the club head when the ball is impacted slightly off the club face center or "sweet spot," thereby increasing club efficiency. Moreover, residual vibrations from club head deformation and rebound following ball strike are uniformly absorbed and dampened by the polyurethane material 36 to substantially reduce vibrational energy transfer to the user through the club shaft 12.

From the foregoing, it should be apparent that the club head 10 of the present invention provides a new and improved construction which overcomes many of the disadvantages of prior art hollow shell metal wood clubs, while also providing increased club range. Further, the present invention provides a metal wood club head 10 which is of relatively simple design and economical construction, and provides a metal wood club having a more solid feel and sound than comparable prior art hollow shell metal wood heads.

While a particular form of the present invention has been illustrated and described, it will be appreciated that various changes and modifications can be made without departing from the spirit and scope of the invention as defined by the following claims.

I claim:

1. A golf club head adapted to be secured to a golf club shaft for use in hitting a golf ball, said club head comprising:

a generally hollow metal shell defining a club head body having vertically spaced top and bottom surface portions interconnected by laterally separated toe and heel side portions and longitudinally spaced back and front end portions, said front end portion being substantially open;

a generally flat sided face plate secured to said shell closing said open front end portion, said face plate having an inner face and an outer face for impacting against a golf ball; and a shock absorbing and reflecting compression insert made of a hard thermosetting polyurethane material disposed within said generally hollow metal shell and extending between said face plate and said back end portion of said club head body, said polyurethane insert having a generally conical shape with an enlarged diameter base end attached to said inner face of said face plate and a small diameter apex end attached to said back end portion of said club head body whereby upon impact of said face plate against a golf ball, compression shock waves produced in said club head body are absorbed and reflected by said insert.

2. A golf club head as set forth in claim 1 wherein said cone is a right circular cone.

3. A golf club head as set forth in claim 2 wherein said insert further includes a conically shaped metal sleeve concentrically surrounding said polyurethane material, and having a base end secured to said face plate and an apex and end secured to said back end portion of said club head body.

4. A golf club head as set forth in claim 3 wherein said polyurethane material has a Shore D hardness of at least 80.

5. In a golf club head of the metal wood type and comprising a generally hollow metal shell defining vertically spaced top and generally horizontal bottom surface portions interconnected by laterally spaced heel and toe portions and longitudinally spaced front and back end portions, the improvement comprising:

a shock absorbing and reflecting compression insert disposed within said shell and extending between said front and back end portions, said insert comprising a generally cone-shaped hard polyurethane material having a relatively large diameter base end attached to said front end portion of said shell and a relatively small diameter apex end portion attached to said back end portion of said shell.

6. The improvement as set forth in claim 5 wherein said polyurethane material is a thermosetting polyurethane having a Shore D hardness of at least 80.

7. The improvement as set forth in claim 5 wherein said insert includes a conical metal sleeve concentrically surrounding said polyurethane material, said sleeve having an enlarged diameter base end secured to said front end portion of said shell and a small diameter apex end attached to said back end portion of said shell.

8. The improvement as set forth in claim 7 wherein said insert has the shape of a right circular cone uniformly converging between said base end and said apex end, said cone having a longitudinal axis disposed to extend generally parallel with said generally horizontal bottom surface portion of said shell.

9. The improvement as set forth in claim 8 wherein said polyurethane material has a Shore D hardness of at least 80.

* * * * *